US010249976B1

(12) United States Patent
Thomas et al.

(10) Patent No.: US 10,249,976 B1
(45) Date of Patent: Apr. 2, 2019

(54) CONNECTOR HOUSING ASSEMBLY WITH A DRESS COVER HAVING FINGER FEATURE AND RIBS

(71) Applicant: Sumitomo Wiring Systems, Ltd., Yokkaichi-shi, Mie (JP)

(72) Inventors: Raynard Thomas, Farmington Hills, MI (US); Eric Torrey, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/949,731

(22) Filed: Apr. 10, 2018

(51) Int. Cl.
*H01R 13/506* (2006.01)
*H01R 13/58* (2006.01)
*H01R 13/502* (2006.01)

(52) U.S. Cl.
CPC ..... *H01R 13/506* (2013.01); *H01R 13/582* (2013.01); *H01R 13/502* (2013.01); *Y10S 439/906* (2013.01)

(58) Field of Classification Search
CPC .. H01R 13/502; H01R 13/506; Y10S 439/906
See application file for complete search history.

(56) References Cited

U.S. PATENT DOCUMENTS 4,108,527 A * 8/1978 Douty ..... H01R 13/5825 439/465
4,491,381 A * 1/1985 Hamsher, Jr. ..... H01R 23/6873 439/267
4,606,596 A * 8/1986 Whiting ..... H01R 13/58 439/465
4,749,369 A * 6/1988 Wang ..... H01R 13/516 439/459
4,975,078 A * 12/1990 Stroede ..... H01R 4/2433 439/405
7,070,457 B2 * 7/2006 Kluempke ..... H01R 13/514 439/687
7,524,215 B2 4/2009 Banas et al.
8,215,984 B2 * 7/2012 Yokozeki ..... H01R 13/506 439/540.1
9,666,972 B2 * 5/2017 Martin ..... H01R 9/24
2006/0009067 A1 1/2006 Sakamaki et al.

* cited by examiner

*Primary Examiner* — Tho D Ta
(74) *Attorney, Agent, or Firm* — Honigman LLP

(57) ABSTRACT

A connector housing assembly is configured to withstand a cantilevered force applied by wires onto the dress cover and prevent contact between the dress cover sidewalls and the wire or a terminal to reduce disengagement of the connector housing and dress cover. The connector housing includes ridges integrated on the outer surface of the sidewalls of the connector housing. The dress cover includes a finger feature integrated on the sidewalls of the dress cover that engages the ridges of the connector housing to produce a cantilever force that counter acts the force exerted on the dress cover from the of wires. The dress cover further includes stabilizing ribs connected to the interior surfaces of the sidewalls and top surfaces. The stabilizing ribs prevent movement of the assembly causing the terminal or wire from rattling resulting in wear or damage to the wire or terminal.

13 Claims, 8 Drawing Sheets

CONNECTOR HOUSING ASSEMBLY WITH A DRESS COVER HAVING FINGER FEATURE AND RIBS

FIELD OF THE INVENTION

The specification is generally related to connector housing assemblies and particularly to connector housing assemblies having a dress cover configured to prevent detachment of the dress cover from the connector housing.

BACKGROUND

In general, connector housing assemblies are configured to house and protect electrical connections. The connector housing assembly includes a dress cover configured to be removably attached to a connector housing. The connector housing is configured to accommodate at least one terminal connection.

Vibrations from the operating environment of the connector housing assembly or torques applied by an operator assembling the connector housing assembly may translate to a wire or a terminal connector within the connector housing assembly. For instance, vibration from the road may cause the wire to rattle against an inner surface of the sidewall of the connector housing assembly. During assembly, the operator may rotate the wire while routing the wire along a predetermined path which may also cause the wire to engage the inner surface of the dress cover or the connector housing. Additionally, the wire may hang from the connector housing, causing the terminal connector to apply a cantilevered force on the dress cover. In some instances, the connector housing is configured to accommodate a relatively large terminal connection. The size of the terminal connection and the wire increase the force applied to the side walls of the dress cover. In some instances the force applied by the terminal connector to the sidewalls is sufficient to decouple the dress cover from the connector housing.

Accordingly, it remains desirable to have a connector housing assembly that decreases the probability of detachment of the dress cover from the connector housing either during or after assembly. As such it is desirable to a have a connector housing assembly that withstands the forces applied to the dress cover by a wire.

SUMMARY

In one embodiment the connector housing assembly is configured to prevent detachment of the dress cover and the connector housing by withstanding forces applied to the dress cover by a terminal, wire, and terminal connector, preventing disengagement of the dress cover with the connector housing.

The connector housing assembly includes a dress cover and a connector housing. The connector housing includes a pair of sidewalls, a back wall, and a bottom surface defining a first storage space. The connector housing includes locking nubs and a ridge integrated on the outer surface of the sidewall. The ridge extends along an axis defining the height of the connector housing.

The dress cover has a pair of sidewalls, a front wall, a back wall, and a top surface defining a second storage space. The first and second storage spaces are configured to receive a terminal, a wire, and terminal connector. The dress cover includes locking clips and a tab integrated onto outer surface of the sidewall. The locking clips are configured to engage the locking nubs. The tab is configured to engage the ridge such that when the connector housing assembly is assembled, a planar front edge of the tab contacts a back edge of the ridge. Accordingly, when the connector housing and dress cover are coupled the ridge abuts the side of the tab. As the side of the tab engages the elongated ridge, movement of the tab with respect to the connector housing is prevented. Accordingly, the engagement of the ridge and the tab counteract the cantilevered force applied on the dress cover resulting from the wire hanging from the end of the connector housing.

The connector housing assembly is further configured to prevent rattling of the terminal or wire with the dress cover that may result from vibrations during operation. The dress cover includes at least one pair stabilizing ribs connected to the interior surfaces of the sidewalls having free ends extending into the second storage space. The stabilizing ribs are each disposed on opposite inner surfaces of the dress cover and are spaced apart from each other and opposite of each other so as to form a gap. The gap is configured to accommodate the wire and terminal and is further dimensioned to limit the movement of the terminal and wire caused by rattling or torques applied to the wire during manufacturing or vibrations during operation.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Referring generally to the figures, the embodiments of the present disclosure include a connector housing assembly having a connector housing and a dress cover. The dress cover is removably attached to the connector housing. When coupled together, the dress cover and the connector housing define a storage space to house a terminal, a terminal connector, and a wire. The connector housing assembly is configured to prevent the detachment of the dress cover from the connector housing. In particular, the connector housing assembly is configured to retain the dress cover to the connector housing under predetermined vibration and torque.

The connector housing includes a pair of first sidewalls and a bottom surface defining a first storage space. The connector housing further includes locking nubs and ridges formed on the first sidewalls. The ridges are spaced apart from each other and extend along an axis defining the height of the connector housing. The dress cover includes a pair of second sidewalls, a back wall, and a top surface defining a second storage space. The dress cover further includes locking clips and tabs disposed on the second sidewalls. The locking nubs and the locking clips are configured to engage each other so as to secure the connector housing and the dress cover to each other.

The tab of the dress cover is an elongated member having a front side. The front side extends along an axis defining the height of the dress cover. A front side of the tab is configured to engage a back side of the ridge. The back side of the ridge extends along the axis defining the height of the connector housing. In such a manner, contact between the tab and the ridge restricts forward movement of the tab with respect to the connector housing and withstands the cantilevered force the hanging wire may apply on the dress cover The dress cover further includes a pair of stabilizing ribs disposed on the interior side of the second sidewalls. The stabilizing ribs are opposite of each other and extend into the second storage space so as to form a gap configured to accommodate terminal, the terminal connector, and the wire. The free ends of the stabilizing ribs are configured to receive a load from the terminal, wire, and/or terminal connector so as to minimize movement of the wire and the terminal connector which reduces the side-to-side load on the terminal.

Accordingly, the connector housing assembly is configured to prevent detachment of the dress cover from the connector housing by withstanding the cantilever forces put on the dress cover by the hanging wire and minimize wear and damage to the terminal connector caused by the side-to-side movement of the wire due to vibrations.

Figure 6:
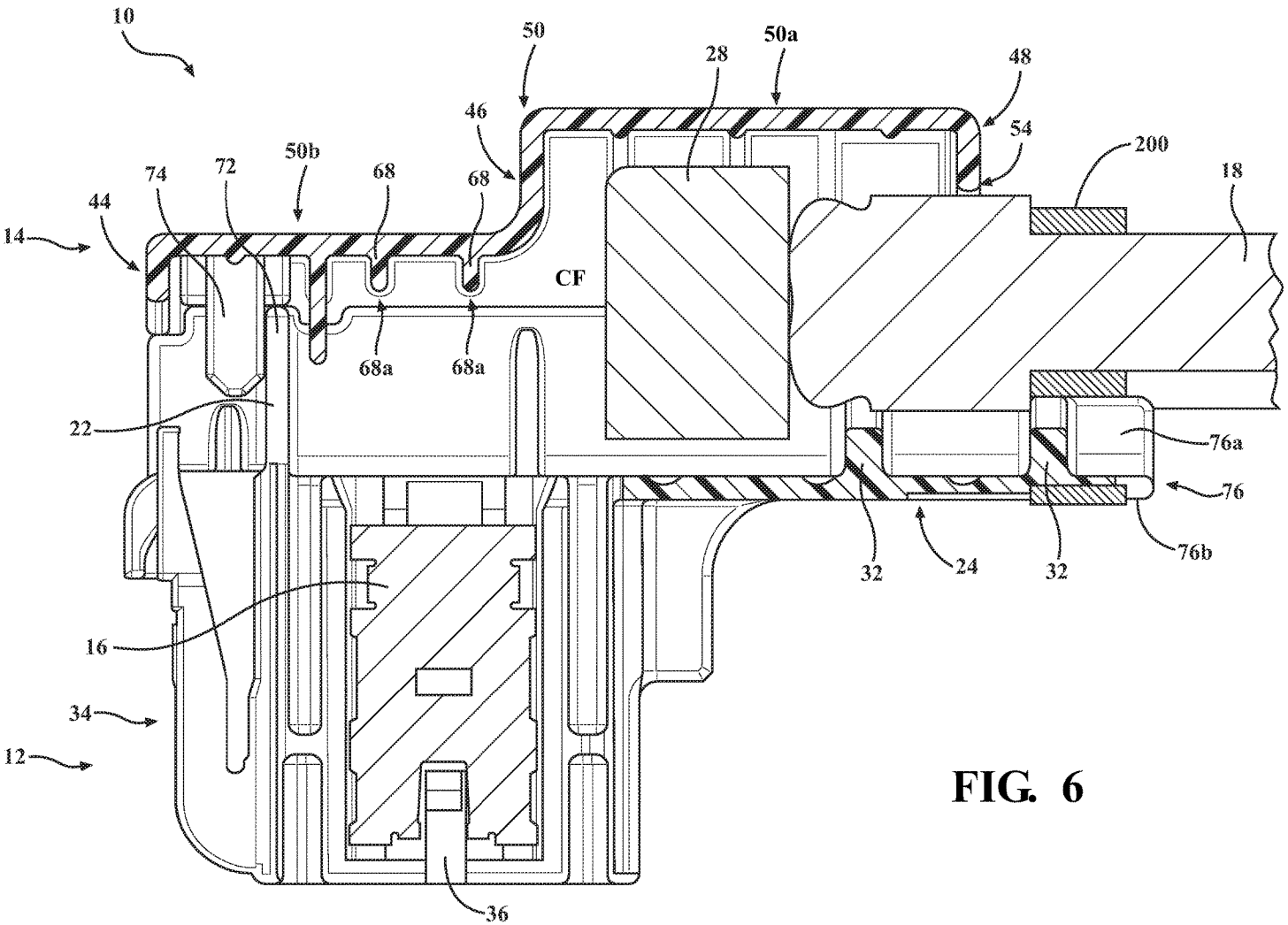
FIG. 6 is a side cross-sectional view of the connector housing assembly shown in FIG. 5 taken along line 6-6.

As used herein the term "back" refers to the side of the connector housing assembly through which the wire enters the connector housing assembly and the term "front" refers to the opposite side of the connector housing assembly. References to the terms "top" and "bottom" are made with respect to the orientation of the connector housing assembly as shown in the referenced drawing. The term "height" refers to the dimension of component between the top and bottom of that component as previous defined. Additionally, the terms "outward" or "inward" are made in reference to the relative position of a component with respect to the center-line of the connector housing assembly, wherein the center-line is generally defined by the axial length of the wire and wire terminal as shown in FIG. 6. The term "side-to-side" is made in reference to movement made alternately from one side of the center line of the connector housing assembly in a direction orthogonal to the first and second sidewalls.

Figure 1:
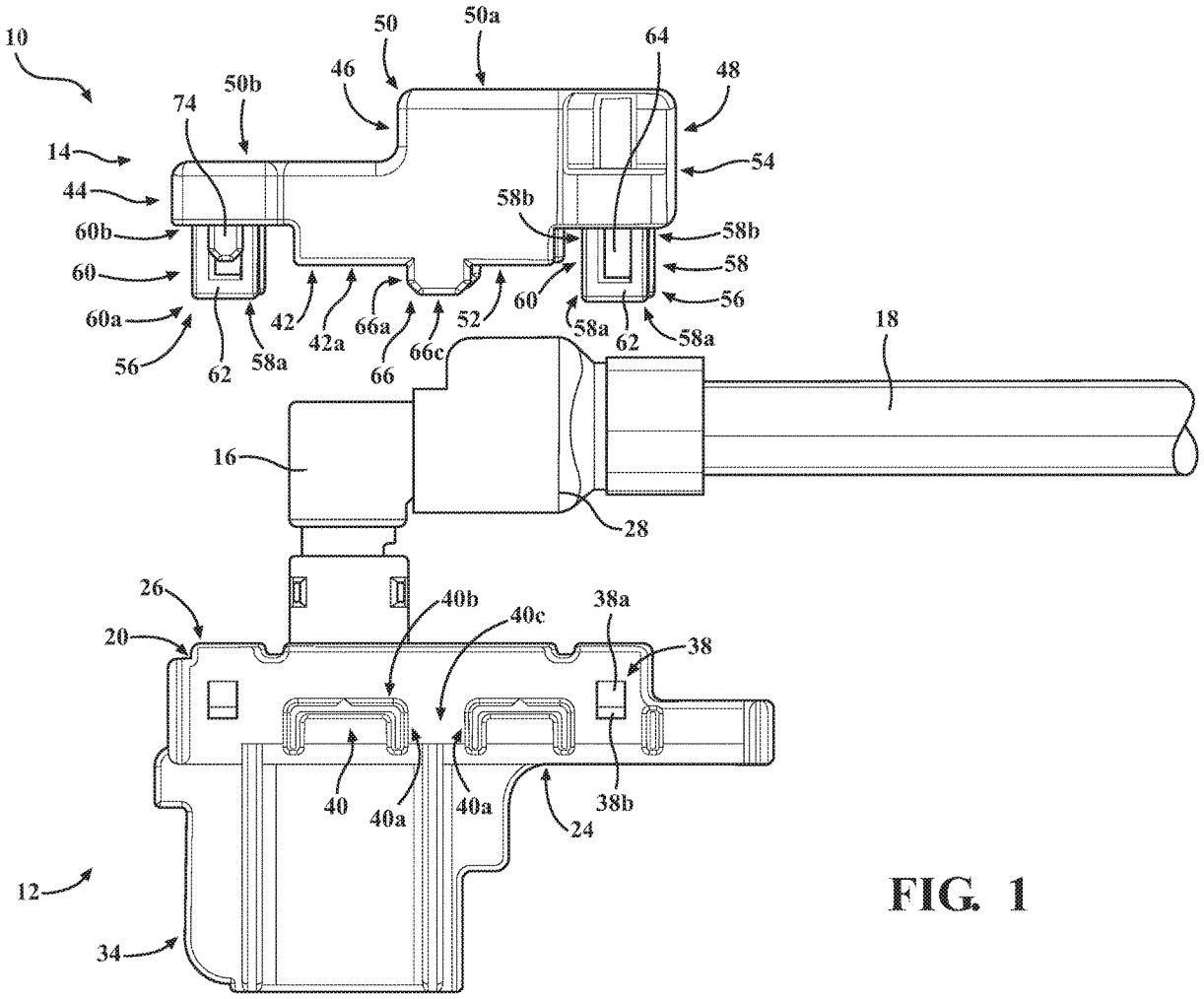
FIG. 1 schematically depicts an exploded side view of a connector housing assembly in accordance with one or more embodiments described and illustrated herein.
Figure 2:
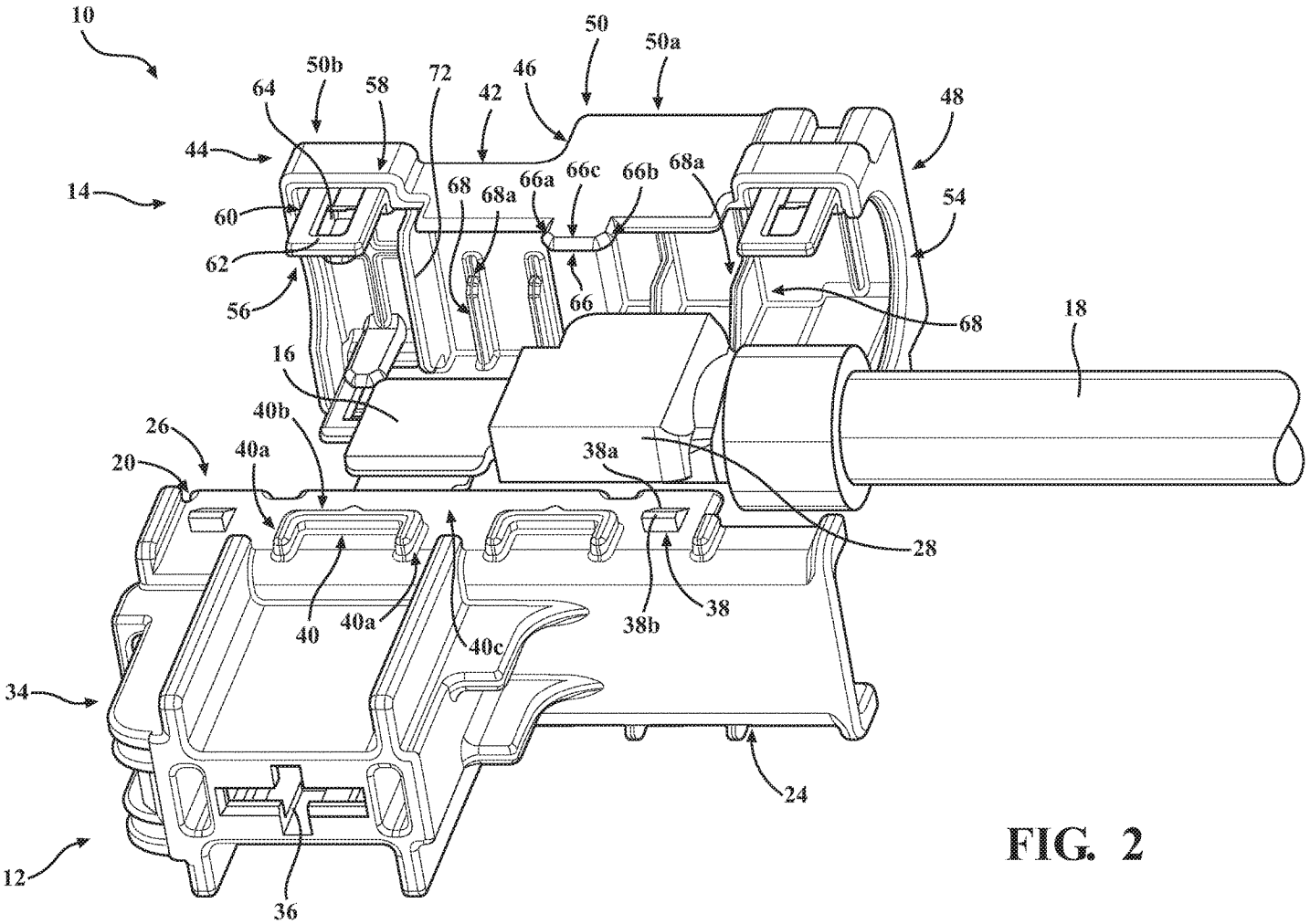
FIG. 2 is an isometric bottom view of the connector housing assembly shown in FIG. 1.

With reference now to FIGS. 1 and 2 an exploded view of the connector housing assembly 10 is provided. The connector housing assembly 10 includes a connector housing 12 and a dress cover 14. The connector housing 12 is configured to couple with the dress cover 14. The connector housing assembly 10 houses a terminal 16 and a wire 18 so as to protect the terminal 16 and the wire 18 from damage. The connector housing 12 and the dress cover 14 may be formed of a durable and resilient material suitable for use in the injection molded process, such material illustratively includes polypropylene.

Figure 3:
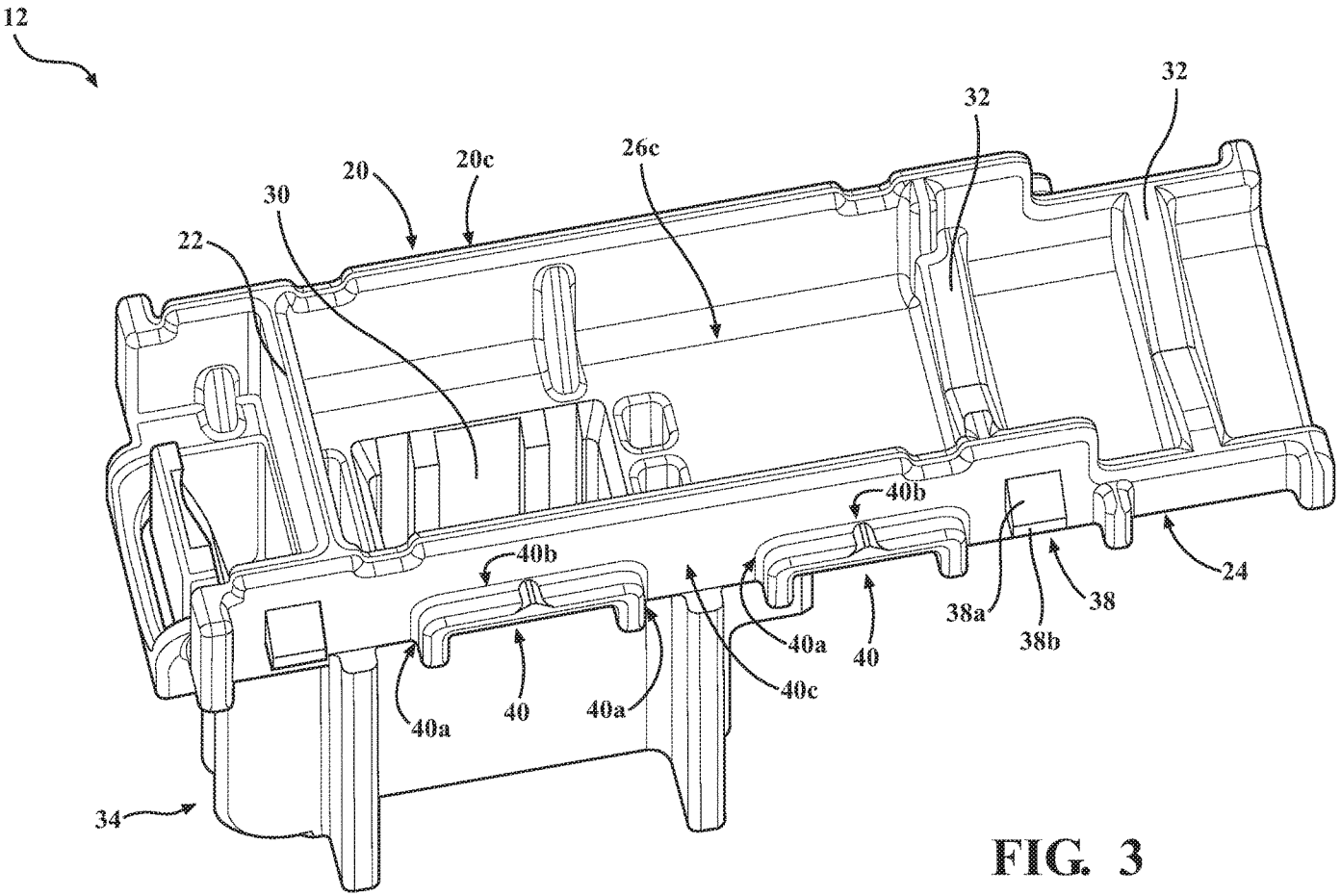
FIG. 3 is a view of the interior of the connector housing.

With reference again to FIGS. 1 and 2 now to FIG. 3, an illustrative depiction of the connector housing 12 is provided. The connector housing 12 includes a pair of first sidewalls 20, a front wall 22, and a bottom surface 24 defining a first storage space 26. The first storage space 26 is configured to accommodate the terminal 16, the wire 18, and a terminal connector 28 joining the terminal 16 and the wire 18. Each of the pair of first sidewalls 20 has an upper edge 20*a*. The bottom surface 24 includes a terminal opening 30 and wire supports 32. The terminal opening 30 allows for the terminal 16 to be inserted into a base 34 that surrounds the terminal 16. The base 34 includes a terminal slot 36 which allows for a connection between the terminal 16 within the connector housing assembly 10 and a complementary terminal (not shown).

The connector housing 12 includes a locking nub 38 that is integrally formed on the outer surface of the first sidewall 20. The locking nub 38 is illustratively shown as being ramp shaped including a ramp surface 38*a* and a planar surface 38*b*. The ramp surface 38*a* is generally angled so as to be flush with the upper edge 20*a* of the first side wall 20, wherein a bottom end of the locking nub protrudes outwardly from the first side wall 20. The figures show the connector housing 12 has four locking nubs 38, two disposed on each of the first sidewalls 20, with one located near the back of the each first sidewall 20 and one located near the front of each first sidewall 20. Each of the four locking nubs 38 has an identical ramp shape as described above. However, it should appreciated that the depiction of the connector housing having four locking nubs 38 is for illustrative purposes and is not limiting to the scope of the claims.

The connector housing 12 further includes a ridge 40 integrally formed on the outer surface of the first sidewall 20. The ridge 40 has a generally elongate shape oriented along an axis defined by a height of the first sidewall 20. The ridge 40 has a planar surface 40*a* facing towards the front of the connector housing assembly 10. The ridge 40 further includes a top surface 40*b*.

In one embodiment, the connector housing includes a pair of ridges 40 formed on a first sidewall 20 where one ridge 40 has a planar surface 40*a* facing the back of the connector housing assembly 10 and the other ridge 40 has a planar surface 40*a* facing the front of the connector housing assembly 10. Each of the pair the pair of ridges 40 are spaced apart such that the planar surfaces 40*a* form a slot 40*c*. It should be appreciated that the locations of the ridges 40 as shown in the figures is for illustrative purposes and is not limiting to the scope of the claims.

Figure 4:
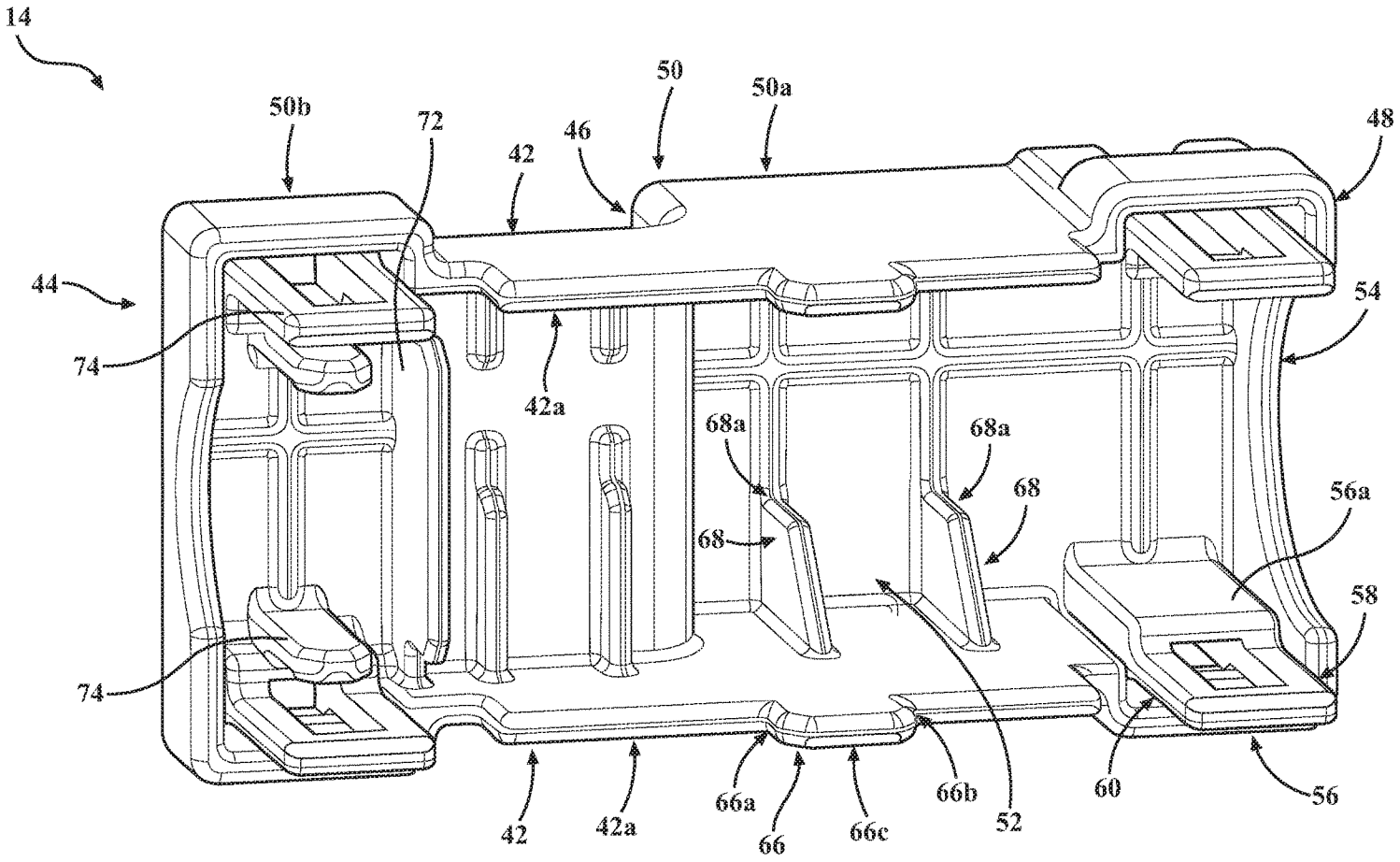
FIG. 4 is a view showing the interior of the dress cover.

With reference again to FIGS. 1 and 2 and now to FIG. 4, an illustrative depiction of the dress cover 14 is provided. The dress cover 14 includes a pair of spaced apart second sidewalls 42, a front wall 44, an intermediate wall 46, a back wall 48, and a top surface 50 defining a second storage space 52. The second storage space 52 is configured to house the terminal 16, the wire 18, and the terminal connector 28. Each of the pair of second sidewalls 42 has a lower edge 42*a*. The front wall 44, intermediate wall 46, and the back wall 48 are parallel to one another. The top surface 50 is generally orthogonal to the front wall 44, the intermediate wall 46, and the back wall 48. The back wall 48 includes a wire opening 54 configured to receive the wire 18 so as to allow the wire to lie within the connector housing assembly 10. The wire opening 54 is illustratively shown as an arcuate inner edge.

In one embodiment, the top surface includes a first portion 50*a* elevated with respect to a second portion 50*b*. The first portion 50*a* and the second portion 50*b* are generally parallel to each other. An intermediate wall 46 connects the first portion 50*a* of the top surface 50 to the second portion 50*b* of the top surface 50 and defines the distance the first portion 50*a* is elevated from the second portion 50*b*.

The terminal 16, the wire 18, and the terminal connector 28 are housed within the first storage space 26 and the second storage space 52. The terminal connector 28 and an adjacent portion of the wire 18 have a layer of insulation (not shown) applied to the outer surfaces. For illustrative purposes, the wire 18 is shown as a coaxial wire having a diameter of 9.5 mm, the terminal 16 is a male terminal configured to complete an electrical connection for a 24 volt power supply. As shown, the wire 18 hangs from a back end of the terminal connector 28 creating a cantilevered force.

It should be appreciated that the wire 18 may be formed of multiple individual wires contained within a single sheath and that each of the individual wires may vary in size with respect to one another. The number of wires may also vary such that the collective diameter of the multiple wires is a predetermined diameter. The size and dimension of the wire 18 is provided for illustrative purposes and is not limiting to the scope of the claims.

The dress cover 14 further includes a locking clip 56 disposed on the outer surface of one of the pair of second sidewalls 42. The locking clip 56 includes a first leg 58 and a second leg 60. The first leg 58 and the second leg 60 extended downward from the second sidewall 42 of the dress cover 14 to distal ends 58*a* and 60*a* respectively. Opposite the distal ends 58*a*, 60*a* are proximate ends 58*b*, 60*b*. The distal ends 58*a*, 60*a* of the first and second legs 58, 60 are connected by a crossbar 62. The first and second legs 58, 60 are spaced apart such that the first and second legs 58, 60 and the crossbar 62 define a slot 64. The slot 64 has a width configured to slidingly receive the locking nub 38. The locking clip 56 is formed of a resilient material configured to deflect relative to the outer surface of the dress cover 14.

In one embodiment, the dress cover 14 has four locking clips 56 positioned on the second sidewalls 42 of the dress cover 14. Each locking clip 56 is configured to engage a corresponding locking nub 38 of the connector housing 12 so as to secure the connector housing 12 to the dress cover 14. The figures depict two locking clips 56 extending from the first portion 50*a* of the top surface 50 and two locking clips 56 extending from the second portion 50*b* of the top surface 50.

Each of the second sidewalls 42 of the dress cover 14 includes a tab 66 extending downward from the lower edge 42*a* of the second sidewall 42. The tab 66 is an elongated member having a generally rectangular shape with a front edge 66*a*, a back edge 66*b*, and a bottom edge 66*c*. The front edge 66*a* and the back edge 66*b* are planar surfaces. An outer surface of the tab 66 may be planar and generally rectangular in shape. The planar surfaces of the front and back edges 66*a*,66*b* are generally orthogonal to the outer surface of the tab 66. The tabs 66 are configured to engage at least one of the ridges 40 such that the front edge 66*a* of the tab 66 is in contact with the planar surface of the ridge 40 when the connector housing assembly 10 is assembled.

Figure 5:
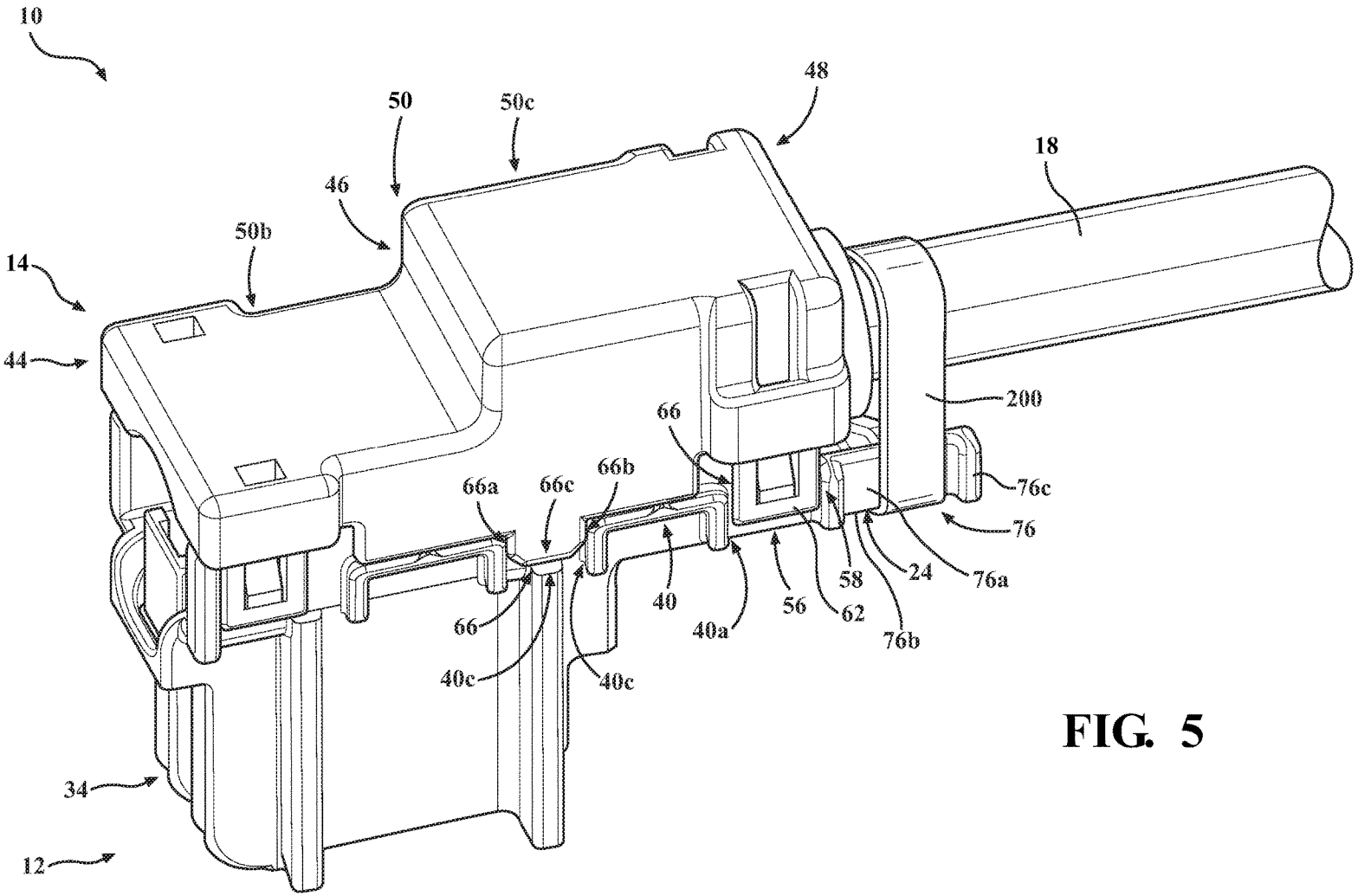
FIG. 5 is an isometric top view of the of the connector housing assembly shown in FIG. 1 fully assembled.

With reference now to FIG. 5, the operation of the connector housing assembly 10 is provided. FIG. 5 shows the connector housing assembly 10 with the dress cover 14 secured to the connector housing 12 with the terminal 16, the wire 18, and terminal connector 28 contained within the first storage space 26 and the second storage space 52. When the connector housing 12 and dress cover 14 are secured, the second sidewalls 42 of the dress cover 14 are located adjacent the outer surface of the first sidewalls 20 of the connector housing 12. Additionally, the lower edge 42*a* of each of the second sidewalls 42 is lower than the upper edge 20*a* of each of the first sidewalls 20. The upper edges 20*a* of the first sidewalls 20 and the lower edges 42*a* of the second sidewalls 42 have beveled edges that assist in guiding the connector housing 12 and dress cover 14 into the proper secured position.

When securing the dress cover to the connector housing, the locking clips 56 engage the locking nubs 38, deflecting outwardly as the locking clips 56 slide over the ramp surface 38*a* of the locking nubs 38. The crossbar 62 of the locking clips 56 slides over the locking nubs 38 until the crossbar 62 passes the planar surface 38*b*, wherein the resiliency of the locking clips 56 snaps the locking clips 56 against the first sidewall 20 of the connector housing 12. The locking nubs 38 are seated within the respective slots 64.

When the terminal 16, wire 18, and terminal connector 28 are contained within the connector housing assembly 10, an end portion of the wire 18 is free to hang. The weight of the hanging wire 18, shown in FIG. 6 as force W, applies a cantilevered force on the dress cover 14. In particular, the cantilever force, shown in FIG. 6 as force CF, from the wire 18 forces the terminal connector 28 upwardly, which in turn applies a load on the top surface 50. As the dress cover 14 is pressed onto the connector housing 12, the locking clips wherein the force from the wire 18 forces the crossbar 62 of the locking clips 56 against the locking nubs 38.

When the connector housing assembly 10 is properly assembled, the tab 66 on the dress cover 14 engages the ridge on connector housing 12. The tab 66 and the ridge 40 are configured such that the front edge of the tab 66 abuts the planar surface 40*a* of the ridge 40. The contact between the front edge 66*a* and the planar surface 40*a* prevents movement of the tabs 66, and consequently the dress cover 14, with respect to the connector housing 12, eliminating or reducing the cantilevered load applied by the terminal connector 28 to the top surface 50.

In one embodiment, the connector housing 12 includes two ridges 40 positioned such that the ridges 40 have a determined space between them, defining the slot 40*c*, that is configured to slidingly receive the tabs 66. The beveled edges of the ridges 40 and the tabs 66 help guide the tabs 66 into the proper configuration between the two ridges 40. When the connector housing assembly 10 is assembled, the front edge 66*a* of the tab 66 is in contact if the planar surface 40*a* of one ridge 40, and the back edge 66*b* is in contact with the planar surface 40*a* of the other ridge 40. In another embodiment, when the connector housing assembly 10 is assembled, the lower edge 42*a* of the second sidewalls 42 rest on the top surface 40*b* of a ridge 40.

The interior of the dress cover 14 includes a pair of stabilizing ribs 68 extending from one of the second sidewalls 42. The stabilizing ribs 68 may have a generally angled shape extending from a second sidewall 42 towards the interior of the second storage space 52. The stabilizing ribs 68 each have a free end 68*a*. The free ends 68*a* of the stabilizing ribs 68 define a gap 70. The width of the gap 70 is configured to provide sufficient space to fit one of the terminal 16, the wire 18, or the terminal connector 28. Each free end 68*a* is also configured to receive a load from the wire 18 or terminal connector 28 so as to minimize movement of the wire 18 and the terminal connector 28. In one embodiment, the gap 70 is generally centered between the second sidewalls 42. A back rib 72 extends the top surface 50, located rearward of the stabilizing ribs 68. The back rib 72 spans the length between the second sidewalls of the connector housing 12, restricting movement of the dress cover 14 with respect to the connector housing 12.

The interior of the dress cover 14 also includes a reinforcing tab 74 disposed on the interior surface adjacent the locking clip 56. It should be appreciated that although the drawings depict reinforcing tabs 74 extend only from the second portion 50*b* of the top surface 50 this configuration is provided for illustrative purposes and is not limiting to the scope of the claims.

Figure 8:
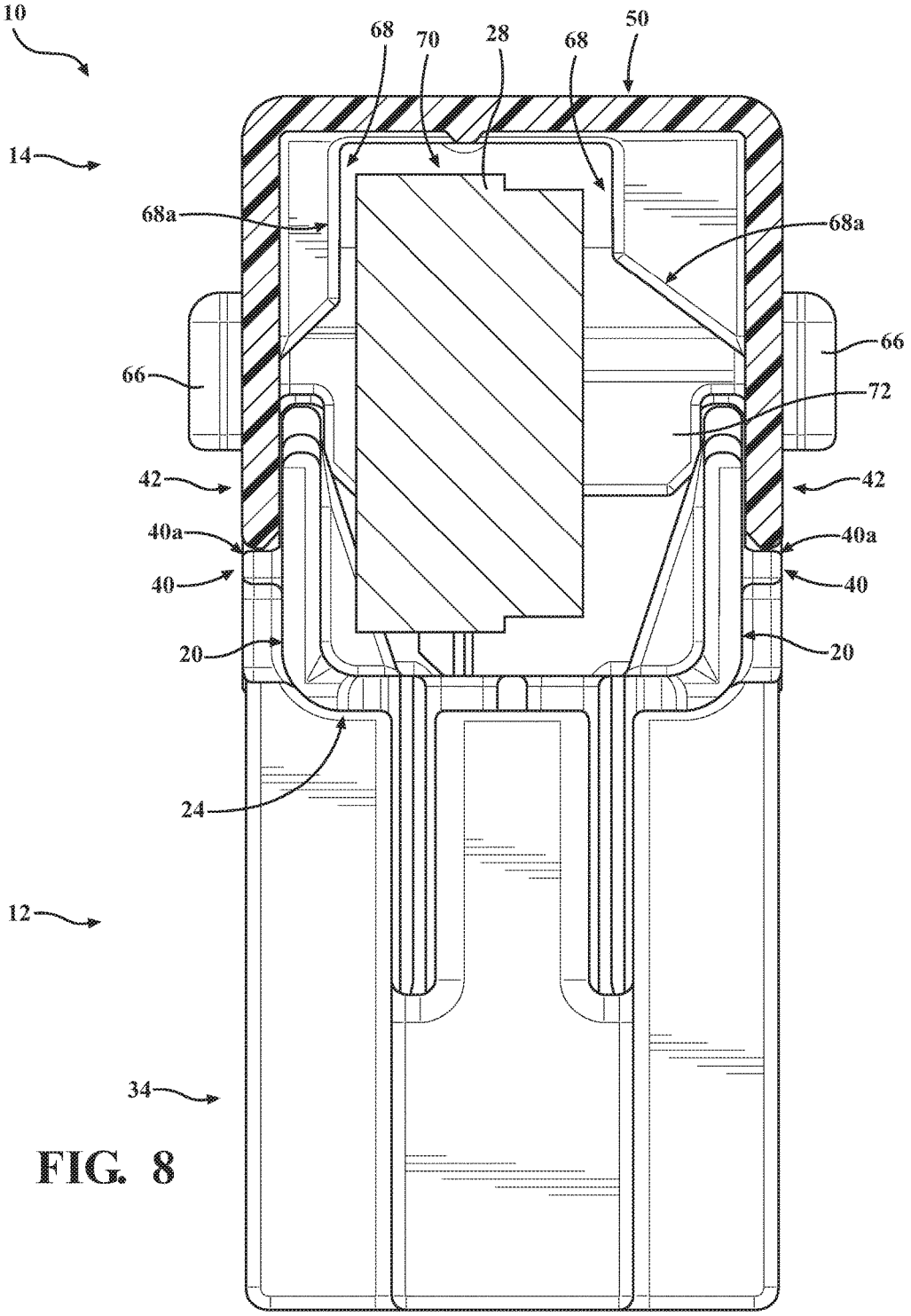
FIG. 8 is a back cross-sectional view of the connector housing assembly shown in FIG. 5 taken along line 8-8.

FIG. 8 shows a cross-section taken at line 8-8 through the terminal connector 28. FIG. 8 depicts stabilizing ribs 68 located on either side of the terminal connector 28 configured to form a gap 70 in which the terminal connector 28 can fit. The stabilizing ribs 68 prevent the direct contact between the terminal connector 28 and the second sidewalls 42 of the dress cover 14 and limit the side-to-side movement of the terminal connector 28. The gap 70 has a width that limits the side-to-side movement of the terminal connector 28. The reduced side-to-side movement of the terminal connector 28 reduces the outward force which the terminal connector 28 can apply to the dress cover 14 when the terminal connector 28 contacts the stabilizing ribs 68. As such, the amount of deflection caused by a collision between the terminal connector 28 and the stabilizing ribs 68 is lessened, lowering the chances of disengagement of the locking clips 56 from the locking nubs 38. Further, the reduced side-to-side movement of the terminal connector 28 reduces bending of the wire 18.

Figure 7:
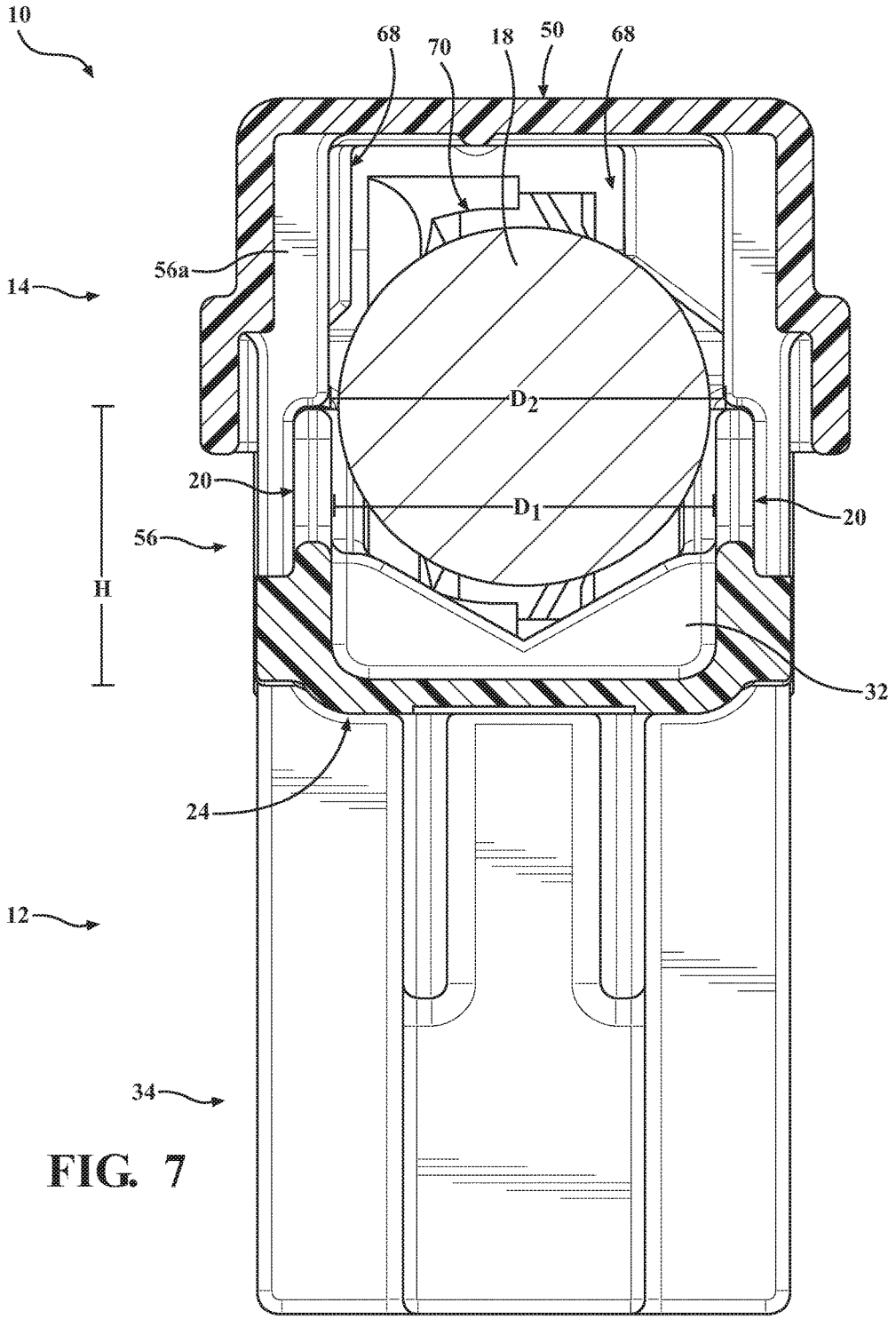
FIG. 7 is a back cross-sectional view of the connector housing assembly shown in FIG. 5 taken along line 7-7.

Referring now to FIG. 7, a cross section taken at line 7-7 through the wire 18 and the locking clip 56 is shown. FIG. 7 depicts the wire 18 lying within the connector housing 12, resting on the wire supports 32. The wire supports 32 span the distance between the first sidewalls 20 of the connector housing 12 and are configured to hold the wire 18 when the wire 18 lies within the connector housing 12. The first sidewalls 20 of the connector housing 12 are spaced apart from each other such that the distance $D_1$ between the first sidewalls 20 is less than the distance $D_2$ between the sidewalls. The first sidewalls 20 also have a height H that is greater than the radius of the wire 18. In some instances, the wire 18 is moved side-to-side during assembly, pressing against the inner surface of the sidewall 42 causing the sidewall 42 to deflect outwardly. Outward deflection of the sidewall 42 may result in disengagement of the locking clip 56 from the locking nub 38 which would result in decoupling of the connector housing 12 and the dress cover 14. However, outward deflection of the first sidewalls 20 will push the locking nubs 38 farther into the slot 64 of the locking clip 56 providing a more secure connection between the connector housing 12 and the dress cover 14. It should be appreciated that the space configured to hold the wire 18 formed between the first sidewalls 20 and the wire supports 32 has a dimension with a tolerance for a varying thickness of the layer of insulation applied on the terminal connector 28 and a portion of the wire 18.

In one embodiment, the connector housing assembly 10 is further configured to receive a strap 200. With reference now to FIGS. 5 and 6, the strap 200 is configured to secure the wire 18 to the connector housing 10. The connector housing 10 includes a strap support 76. The strap support 76 is disposed on the back end of the connector housing 10 and is configured to support the weight of the wire 18 and help retain the wire 18 in an axial orientation.

With reference again to FIGS. 5 and 6 and now to FIG. 2 a description of one aspect of the strap support 76 is provided. The strap support 76 is integrally formed to the connector housing 10. The strap support 76 includes a pair of third side walls 76*a* and a third floor 76*b*. The third side walls 76*a* and the floor 76*b* are generally planar members. The third side walls 76*a* are generally orthogonal to the third floor 76*b* and bound the sides of the third floor 76*b*. The third side walls 76*a* are spaced apart from each other so as to accommodate the diameter of the wire 18. A distal end of the strap support 76 may include a third rib 76*c* disposed on each of the third side walls 76*a*. The third rib 76*c* is configured to prevent the strap 200 from sliding off the strap support 76. FIGS. 5 and 6 show the strap 200 securing the wire 18 to the strap support 76.

Accordingly, the connector housing assembly 10 is configured to withstand the forces applied from a terminal 16, a wire 18, or a terminal connector 28 by providing ridges 40 on the outer surface of the connector housing 12 that abut the locking clips 56 and tabs 66 on the dress cover 14 to produce cantilever forces. The connector housing assembly 10 is further configured to reduce disengagement of the dress cover 14 from the connector housing 12 by providing stabilizing ribs 68 and a back rib 72 on the interior of the dress cover 14 that reduce movement of the terminal 16, the wire 18, and the terminal connector 28 with respect to the connector housing 12 and the dress cover 14 and the outward force the terminal 16, wire 18, and terminal connector 28 can apply to the second sidewalls 42 of the dress cover 14 that can occur during use or manufacturing.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector housing assembly housing a wire and terminal connector, the connector housing assembly configured to prevent detachment of a dress cover and connector housing comprising:

a connector housing having a pair of first sidewalls and a bottom surface defining a first storage space, the connector housing further including a first ridge disposed on an outer surface of each of the pair of first sidewalls, wherein the first ridge has a back side, the back side extending along an axis defined by a height of the connector housing;

a dress cover having a pair of second sidewalls, a front wall, a back wall, and a top surface defining a second storage space, the dress cover further including a tab and a pair of first stabilizing ribs disposed on the inner surface of opposite second sidewalls, the tab extending from a bottom of each of the pair of second sidewalls wherein the tab includes a front edge and a back edge, wherein the back side of a respective first ridge engages the front edge of a respective tab so as to withstand the cantilevered force of a hanging wire, wherein each of the first stabilizing ribs extend into the second storage space to a free end, the free ends defining a first gap, the first gap configured to receive the wire, the first gap having a width that prevents the wire from contacting the second sidewalls so as to limit the side-to-side movement of the wire, minimizing bending of the wire.

2. The connector housing assembly of as set forth in claim 1, wherein the front edge and back edge of the tab are planar surfaces.

3. The connector housing assembly as set forth in claim 1, wherein the distance between each of the second sidewalls is greater than the distance between each of the first sidewalls and the height of each of the first sidewalls is greater than the radius of the wire.

4. The connector housing assembly as set forth in claim 1, further including a strap support, the strap support disposed on the connector housing, the strap support configured to receive a strap for securing the wire.

5. The connector housing assembly as set forth in claim 1, further including a second ridge, the second ridge having a front side, the front side extending along the axis defined by the height of the connector housing, wherein the back side of the first ridge and the front side of the second ridge are spaced apart from each other so as to define a slot, the slot configured to slidingly receive the tab.

6. The connector housing assembly as set forth in claim 5, wherein the back edge of the tab is configured to engage the front side of the second ridge.

7. The connector housing assembly as set forth in claim 5, wherein the back side of the first ridge and the front side of the second ridge each have a planar surface.

8. The connector housing assembly as set forth in claim 1, wherein the first gap is generally centered between the second sidewalls.

9. The connector housing assembly as set forth in claim 8, wherein each of the pair of first stabilizing ribs are located directly opposite of each other on the second sidewalls.

10. The connector housing assembly as set forth in claim 1, further including a pair of second stabilizing ribs extending into the second storage space to a free end, the free ends define a second gap, the second gap is configured to receive the terminal connector, the second gap having a width that prevents the terminal connector from contacting the second sidewalls and limits the side-to-side movement of the terminal connector, further minimizing bending to the wire.

11. The connector housing assembly as set forth in claim 10, wherein the pair of second stabilizing ribs is located between the pair of first stabilizing ribs and the front wall of the dress cover.

12. The connector housing assembly as set forth in claim 10, wherein each of the pair of second stabilizing ribs are located directly opposite each other on the second sidewalls.

13. The connector housing assembly as set forth in claim 10, wherein the second gap is generally centered between the second sidewalls.

* * * * *